United States Patent [19]

Childress

[11] 4,190,385

[45] Feb. 26, 1980

[54] PROTECTIVE CANOPY AND TEMPORARY ROOF SUPPORT FOR MINING MACHINERY

[76] Inventor: Ray Childress, P.O. Box 853, Richlands, Va. 24641

[21] Appl. No.: 948,209

[22] Filed: Oct. 3, 1978

[51] Int. Cl.[2] ..... E21C 11/02

[52] U.S. Cl. ..... 405/288; 175/219; 405/303

[58] Field of Search ..... 405/291-301; 175/219; 173/22, 23, 52; 299/31-33; 91/170 MP; 248/357

[56] References Cited

U.S. PATENT DOCUMENTS

| | | | |
|---|---|---|---|
| 2,806,673 | 9/1957 | Danielsson | 175/219 X |
| 3,113,661 | 12/1963 | Linke et al. | 405/297 |
| 4,079,792 | 3/1978 | Paul et al. | 175/219 X |
| 4,108,253 | 8/1978 | Woodford | 175/219 X |

FOREIGN PATENT DOCUMENTS

| | | | |
|---|---|---|---|
| 1037922 | 8/1966 | United Kingdom | 405/301 |

*Primary Examiner*—Dennis L. Taylor

[57] ABSTRACT

An upright hydraulic jack with a mine roof-engaging pad on its upper end and a skid shoe on its lower end is connected to one side of an elevatable canopy over an operator station.

9 Claims, 3 Drawing Figures

PROTECTIVE CANOPY AND TEMPORARY ROOF SUPPORT FOR MINING MACHINERY

FIELD OF INVENTION

Hydraulic and Earth Engineering, Tunnel Lining, Mobile Props.

PRIOR ART

Childress U.S. Pat. Nos. 4,022,026 and Childress 4,050,259.

BACKGROUND

In certain types of mining operations, machine operators are protected against rock and roof falls by a canopy over the operator's station. In my prior U.S. Pat. No. 4,022,026, the operator's station is located in a shallow, box-like platform pivoted at one end to a roof bolting machine alongside a boom, on the end of which boom is a chuck for driving a drill steel or wrench. The platform can either be "hiked up" for when the roof bolting machine is to be moved for a substantial distance, or let down to float or slide along the ground. Over the platform is a canopy supported by hydraulic jacks at the outer end of the platform so that it may be either swung up and down with the platform, or independently of the platform so that it can be jammed up against the mine roof while the platform rests on the ground.

In my prior U.S. Pat. No. 4,050,257, the platform and canopy are comparable to those in childress 4,022,026, except in that the canopy is supported on the platform by hydraulic jacks at its inner as well as its outer end, and the canopy has a rigid extension on one side which overlies the outer end of the drill chuck boom, and a hole through the canopy accommodates the drill steel or wrench, and a hydraulic jack prop depends from the outer end of the canopy. While that improvement provides great protection for the operator, it lacks the versatility of the subject invention.

OBJECTS

The object of this invention is to provide a temporary roof-support jack which can be extended so as to provide a temporary roof support adjacent to the drilling location, which jack has a ground-engaging skid shoe and a roof-engaging pad. It is further intended that the jack be connected to the canopy over the operator station by an arm which is pivoted to the canopy so that the jack can be extended and used as a temporary roof support without correspondingly raising the canopy.

A further objective is to connect the temporary roof support jack to the chassis of the host machine, such as a mine roof drilling and bolting machine, so that it can be slid along the ground on its ground-engaging skid shoe as the host machine moves along the ground. A further object is to provide a means for limiting the downward pivotal movement of the arm which connects the jack to the canopy, so that when the jack is shortened, its ground-engaging skid shoe is lifted above the ground.

These and other objects will be apparent from the following specification and drawings, in which.

Figure 1:
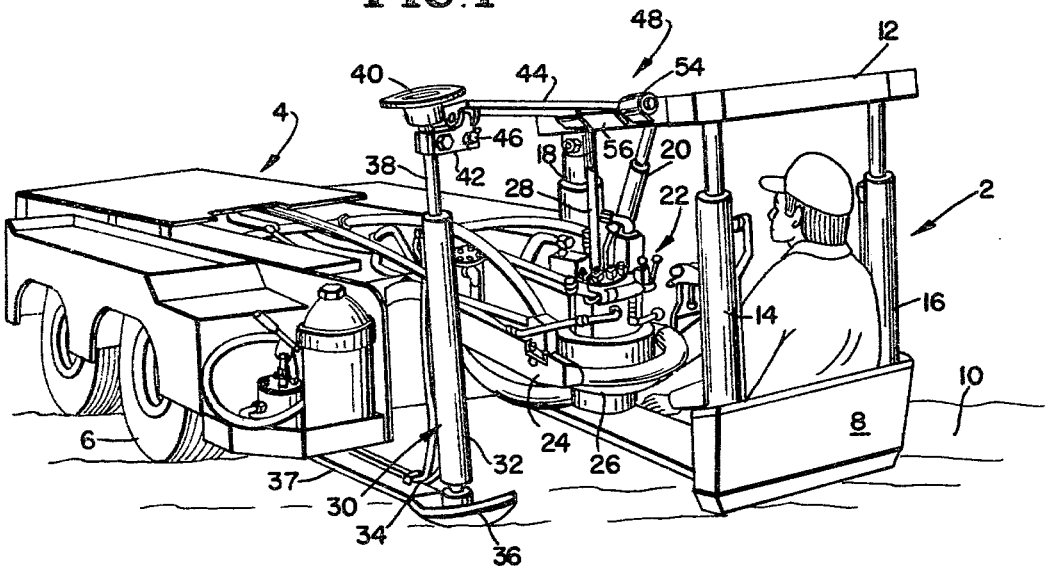
FIG. 1 is a perspective view of an end of a roof bolting machine with the operator station and canopy, with a temporary roof support jack.

Referring now to the drawing, in which like reference numerals denote similar elements, FIG. 1 shows the operator's station 2, the front end of which is pivoted to the chassis of a mine roof drilling and bolting machine 4 which moves along the ground on its wheels 6. The pivotal connection of the operator station with the chassis of the roof drilling and bolting machine is not shown, but this is fully disclosed in my prior patents (supra). The outer end 8 of the operator's station can either be maintained in the floating position of FIG. 1 against the ground or, alternatively, it may be lifted up above the ground. Over the operator's station is a canopy 12 supported at its outer end by hydraulic jacks 14 and 16 and at its inner end by a jack 18, and is further supported by an extensible brace 20. At the operator's station are controls 22 for the boom 24 of the mine roof drilling and bolting machine, the chuck 26 which drives a wrench 28 or a drill steel, and for the other functions of the host machine and the operator's station and canopy.

The improvement with which this invention is concerned is the temporary roof support jack 30 having a cylinder 32 supplied with conventional hydraulic fluid lines 34. The hydraulic fluid is controlled by suitable control means at the operator's station. On the lower end of the cylinder 32 is a ground-engaging skid shoe 36.

Figure 3:
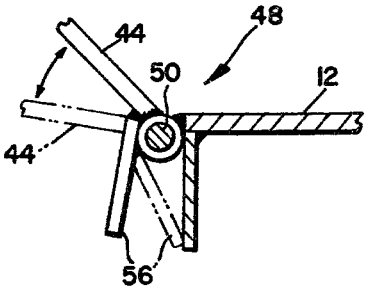
FIG. 3 is a fragmentary sectional view of the canopy and arm pivoted thereto and the stop for limiting the downward pivotal movement of the arm.

The skid shoe 36 is connected by a link 37 to the forward end (not shown) which is pivoted to the chassis of the mine roof drilling and bolting machine 4 so that when the latter moves forwardly and rearwardly, it pulls or pushes the jack with it. Swiveled to the upper end of the jack ram 38 is a roof-engaging pad 40. Clamped around the jack ram 38 is a collar 42, and to this one end of, an arm 44 is pivoted as at 46, the other end of arm 44 being pivoted as at 48 to the canopy 12. The pivotal connection 48 includes a pintle 50 rigid with arm 44, and the ends of pintle 50 are rotatably supported in trunions 52, 54. Rigid with arm 44 and pintle 50 is a stop lever 56. From FIGS. 1 and 3 it will be apparent that the stop lever 56 engages against canopy 12 to limit the downward swinging movement of arm 44 to at or near the horizontal, as illustrated in FIG. 1.

Figure 2:
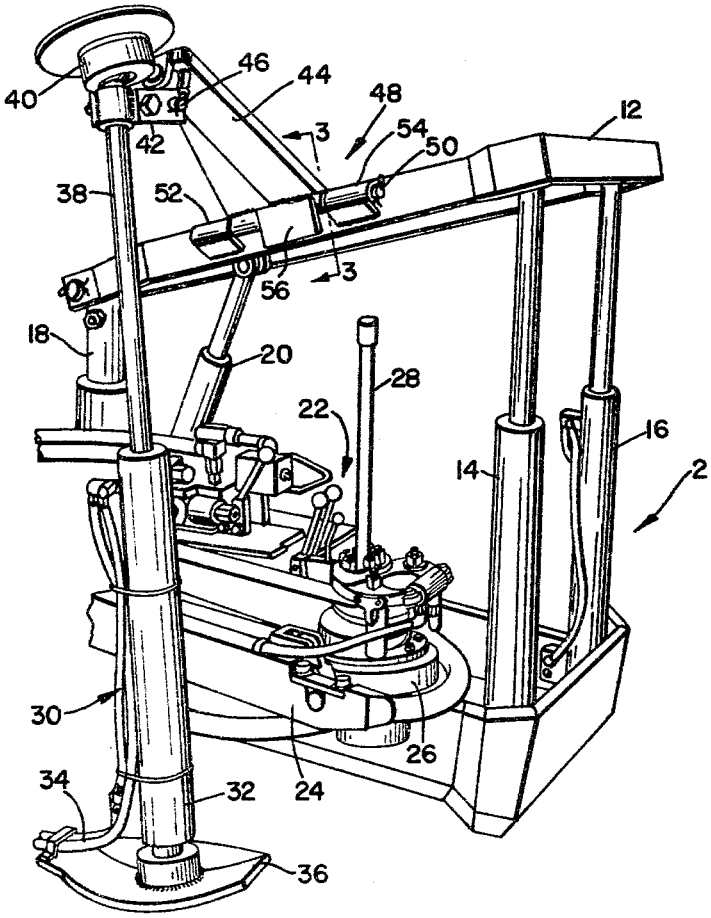
FIG. 2 is a fragmentary view similar to FIG. 1, showing the jack extended above the canopy over the operator station.

In operation, when the mine roof drilling and bolting machine is to be moved from place to place, hydraulic fluid is withdrawn from jack 30 so as to shorten it. Since arm 44 cannot swing down any farther than is shown in FIG. 1, the skid shoe 36 is lifted above the ground. Alternatively, the assembly can be moved from place to place with the skid shoe 36 dragging along the ground. When a drilling and bolting location is reached, pressure fluid may be fed to the jack cylinder 32 so as to extend ram 36 upwardly to force pad 40 against the mine roof adjacent to the spot in the roof to be drilled. The arm 44 provides some protection for the boom 24. From FIG. 2 it will be apparent that the canopy 12 can be raised or lowered to a limited extent independently of the temporary roof support jack 30, and the latter can be extended upwardly without necessarily raising canopy 12.

What is claimed is:

1. A temporary roof support for an ambulatory mining machine having a chasis, means for supporting the chassis for movement along the ground, means providing an operator station for said machine, a canopy over the operator station, and means for raising and lowering the canopy, the improvement which comprises:

a lengthwise extensible-retractable jack adapted to be vertically disposed away from one side of the operator station and having upper and lower end portions, pressure fluid means for extending and retracting the jack, mine-roof and ground-engaging means on the upper and lower portions respectively of the jack, an arm, horizontal pivot means connecting opposite ends of said arm respectively to said canopy and the upper end portion of the jack, and control means at said operator station for said pressure fluid means and for said mining machine.

2. A temporary roof support as claimed in claim 1, and means for limiting the downward pivotal movement of the arm with respect to the canopy below a position in which the arm extends generally horizontally outward from the canopy whereby to suspend said jack from the canopy upon contraction of the jack to a length substantially less than the height of the canopy above the ground.

3. A temporary roof support as claimed in claim 2, the means for limiting the downward pivotal movement of the arm comprising a stop member rigid with the arm and engageable against a part of the canopy.

4. A temporary roof support is claimed in claim 1, and link means for connecting the lower end portion of the jack to the machine chassis, whereby movement of the chassis along the ground correspondingly moves the jack.

5. The combination claimed in claim 4, said ground-engaging means comprising a skid shoe.

6. The combination claimed in claim 1, said mine roof-engaging means comprising a pad formed of a plate swiveled to the upper end portion of the jack.

7. In a mine roof drilling and bolting machine having a chassis, means for supporting the chassis for movement along the ground, a boom extending outwardly from one end of the machine and having a chuck on its outer end, means on said machine providing an operator station disposed on side of the boom, and a canopy over said operators station, the improvement which comprises an extensible-retractable jack disposed on that side of the boom which is opposite the side upon which the operator's station is disposed, said jack having upper and lower end portions with mine-roof and ground-engaging means respectfully on said upper and lower end portions, arm and horizontal pivot means providing a mechanical connection between the canopy and the upper end portion of the jack, whereby the upper end portion of the jack is spaced by said arm from the canopy and is moveable upwardly and downwardly with respect to the canopy, and means at said operator's station for controlling said machine, jack, boom and chuck.

8. In the combination claimed in claim 7, means for raising and lowering said canopy, and stop means for limiting the downward pivotal movement of the arm with respect to the canopy, whereby said jack may be suspended from said canopy.

9. The combination claimed in claim 7, and means for connecting the lower end portion of the said jack to the chassis, whereby movement of the machine in one direction or the other correspondingly moves the jack with it.

* * * * *